US005474011A

United States Patent [19]

Steinberg

[11] Patent Number: 5,474,011

[45] Date of Patent: Dec. 12, 1995

[54] SHOCK ABSORBING APPARATUS FOR HYDROFOIL WATERCRAFT

[76] Inventor: Amiram Steinberg, Moshav Avichail 42910, Israel

[21] Appl. No.: 204,201

[22] PCT Filed: Sep. 3, 1992

[86] PCT No.: PCT/US92/07444

§ 371 Date: Jul. 26, 1994

§ 102(e) Date: Jul. 26, 1994

[87] PCT Pub. No.: WO93/04909

PCT Pub. Date: Mar. 18, 1993

[30] Foreign Application Priority Data

Sep. 9, 1991 [IL] Israel ..... 99447

[51] Int. Cl.[6] ..... B63B 1/30

[52] U.S. Cl. ..... 114/282; 114/279

[58] Field of Search ..... 114/274, 275, 114/279, 280, 282

[56] References Cited

U.S. PATENT DOCUMENTS

| | | | |
|---|---|---|---|
| 3,236,202 | 2/1966 | Quady et al. | 114/66.5 |
| 3,661,110 | 5/1972 | Pont | 114/66.5 H |
| 4,080,922 | 3/1978 | Brubaker | 114/282 |
| 4,955,312 | 9/1990 | Magazzu' | 114/280 |

FOREIGN PATENT DOCUMENTS

| | | |
|---|---|---|
| 2652056 | 3/1991 | France . |
| 768045 | 4/1955 | Germany . |

*Primary Examiner*—Jesus D. Sotelo
*Attorney, Agent, or Firm*—Ladas & Parry

[57] ABSTRACT

Watercraft including a hull (10), a plurality of foils (12) mounted on the hull for engaging a water surface, and shock absorbing means (16, 18) associated with the plurality of foils for coupling the plurality of foils to at least a portion of the hull and providing at least partial absorption of shock received from waves.

16 Claims, 14 Drawing Sheets

SHOCK ABSORBING APPARATUS FOR HYDROFOIL WATERCRAFT

FIELD OF THE INVENTION

The present invention relates to watercraft generally and more particularly to hydrofoil watercraft.

BACKGROUND OF THE INVENTION

There exists a variety of watercraft including hydrofoils. A preferred embodiment of watercraft including a retractable hydrofoil is described in applicant's U.S. Pat. No. 4,715,304 and in the references cited therein.

There exists a general problem of shock absorption in watercraft, which has long ago been solved for land vehicles. In watercraft the hull is directly impacted by surface variations in the water and the impact affects passengers and vehicle operators in the bridge and on the decks of the craft. High speed operation of watercraft of a size and weight which is sensitive to such impacts often results in discomfort and even injury to operators and often requires limitations in operating speeds of watercraft, which would otherwise not be required.

SUMMARY OF THE INVENTION

The present invention seeks to provide improved watercraft which provides shock absorption between a water engaging surface and at least a portion of the hull.

There is thus provided in accordance with a preferred embodiment of the present invention, watercraft including a hull, a plurality of foils mounted in the hull for engaging a water surface and shock absorbing means associated with the plurality of foils for coupling the plurality of foils to at least a portion of the hull and providing at least partial absorption of shocks received from waves.

The term "foil" is to be understood in a broad sense to include any hydrodynamic surface which is separate from the hull of the watercraft.

In accordance with a preferred embodiment of the invention, the plurality of foils may be retractable.

Preferably the shock absorbing apparatus includes pivotably mounted shock absorbers engaging the plurality of foils on opposite surfaces thereof.

In accordance with a preferred embodiment of the present invention, the shock absorbing apparatus includes apparatus for accommodating variations in the position of the plurality of foils.

Additionally in accordance with a preferred embodiment of the invention, the foils include shock absorber engagement grooves formed in opposite surfaces thereof and the shock absorbing apparatus includes apparatus for engaging the grooves at different locations therealong depending on the positions of the foils.

Further in accordance with a preferred embodiment of the invention there is provided shock absorber mounted apparatus for selectably retracting the plurality of foils.

Additionally in accordance with a preferred embodiment of the invention the shock absorber mounted apparatus for selectably retracting the plurality of foils includes a motor driven worm gear assembly operatively engaging a threaded groove formed on a surface of each of the plurality of foils.

Further in accordance with a preferred embodiment of the present invention, each of the plurality of foils includes a main portion and a tip portion which is selectably positionable relative to the main portion.

Additionally in accordance with a preferred embodiment of the present invention there is provided automatically operable hydraulic apparatus for positioning the tip portion relative to the main portion as a function of the angular orientation of the foil.

In all of the following operational modes, the system comprises a hull including hydrofoils, the hull being affected by waves all of the time or part of the time.

The foils may operate as full hydrofoils supporting the entire weight of the craft or as partial hydrofoils supporting only part of the weight of the craft, while the rest of the weight is supported by buoyancy or dynamically by a planing bottom having a sufficient planing surface to create required lift. The foils may operate not only as hydrofoils but also as planing surfaces extending the natural hull planing surface, enabling a craft to maintain planing at a higher displacement. In this mode, part of the foil surface may act as a planing surface, while the part submerged in water acts as a foil element. The foils may further operate as stabilizers designed to prevent excessive craft motion in rough water operation. For certain sizes of water craft the shock absorber system may contribute to overall improved craft motion.

Generally speaking, one of the essential features of the present invention is the provision of shock absorbing apparatus associated with a plurality of hydrodynamic surfaces, which may serve several functions.

When the relative hydrodynamically developed lift forces of the hydrodynamic surfaces are high in relation to the weight of the water craft, the shock absorbing apparatus will dampen hull vertical acceleration and improve the comfort of operators and passengers. Hydrodynamic surfaces may be hydrofoils or planing surfaces, retractable or non-retractable, as described hereinbelow.

For large water craft, the shock absorbing apparatus will dampen vertical acceleration of the hydrodynamic surfaces, as opposed to the hull, in violent storm conditions or in the presence of underwater explosions creating great impacts on the hydrodynamic surfaces. This serves to protect the hydrodynamic surfaces and to prevent tearing out of hinges and anchoring. After the acceleration has subsided, the hydrodynamic surfaces will continue to operate in a more or less fixed position relative to the hull or may even operate while in damped motion relative to the hull.

In large water craft equipped with shock absorbing apparatus associated with a plurality of hydrodynamic surfaces, the hydrodynamic surfaces may serve as stabilizers designed to decrease rolling in rough conditions. In submarines, hydrodynamic surfaces may be control surfaces such as diving fins.

Wherever hydrodynamic surfaces are required, and especially where retractability is needed, attachment of hydrodynamic surfaces associated with shock absorbing apparatus to watercraft improves the reliability and protects the attachment thereof to the hull by absorbing forces and moments exerted on the hydrodynamic surfaces.

Additionally in accordance with a preferred embodiment of the present invention, the shock absorbing apparatus comprise fluid filled pillows.

Preferably, the fluid filled pillows are arranged on opposite sides of each foil and are arranged to permit fluid flow between at least one pillow on one side of each foil to at least one pillow on the other side of the foil.

In accordance with a preferred embodiment of the present invention, a valve is interposed between at least one pillow on one side of each foil and at least one pillow on the other side of the foil to control the fluid flow therebetween.

Additionally in accordance with a preferred embodiment of the invention, apparatus may be provided from the fluid filled pillows to the hydraulic apparatus.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1:
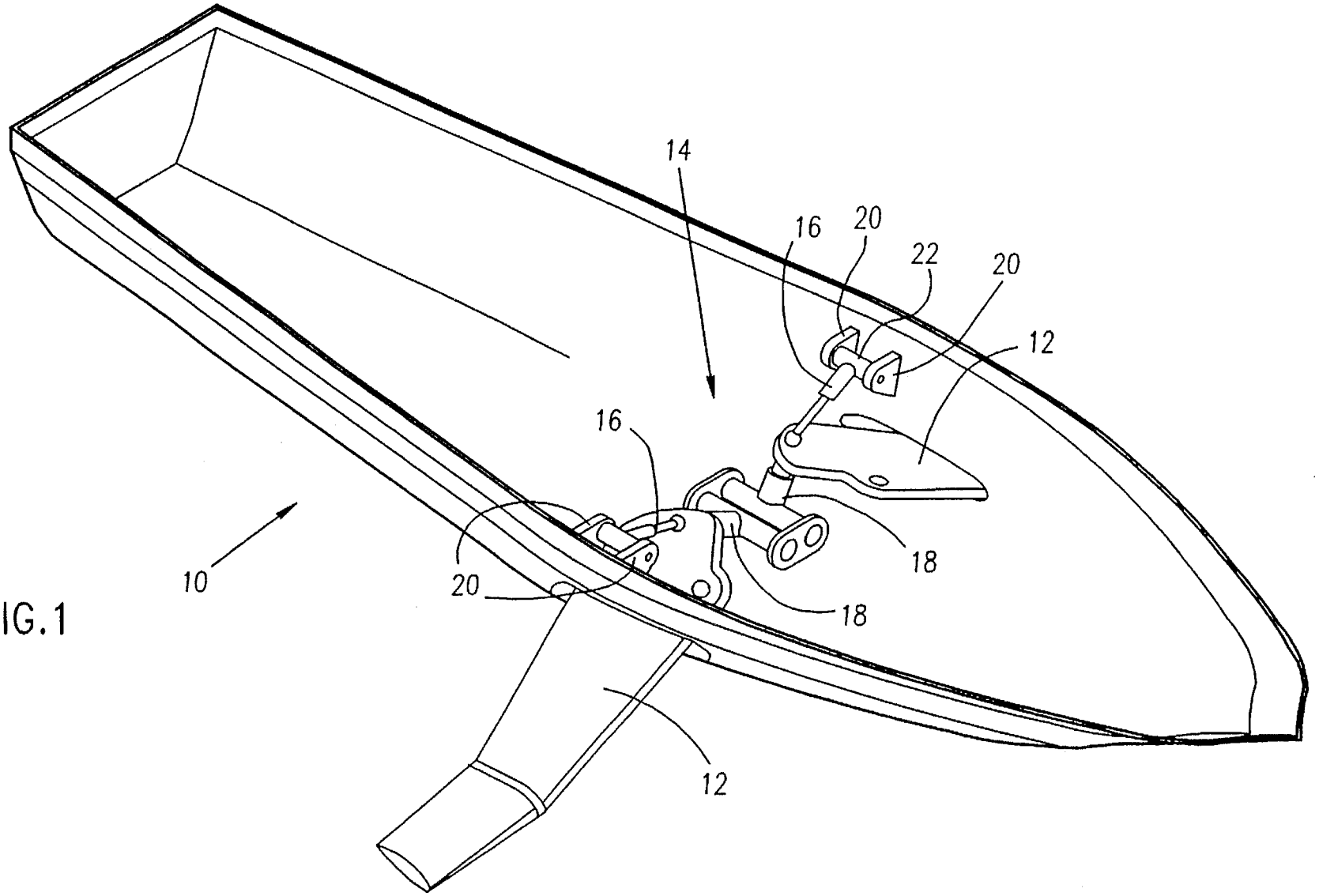
FIG. 1 is a partially schematic, partially pictorial illustration of watercraft including shock absorbers in accordance with a preferred embodiment of the present invention.
Figure 2A:
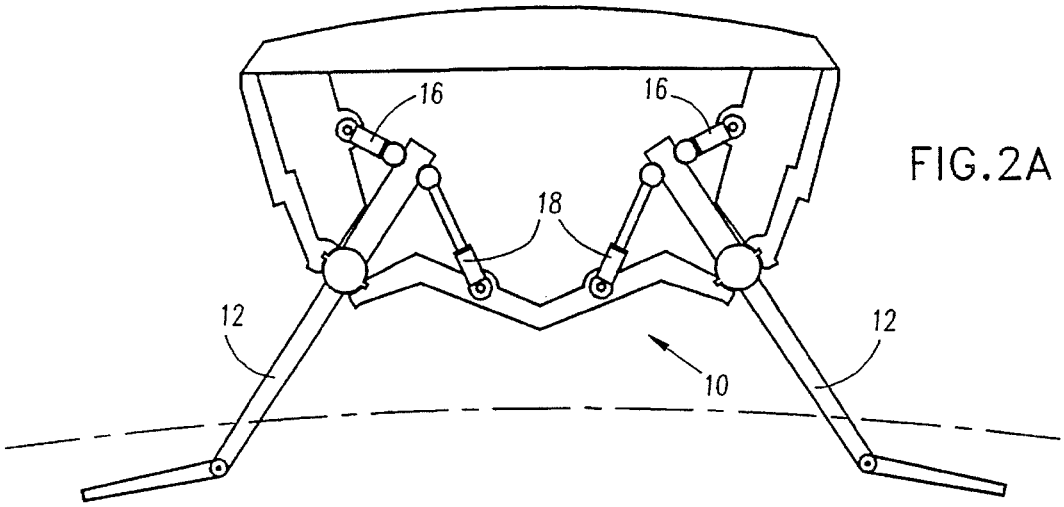
FIGS. 2A, 2B and 2C are illustrations of the operation of the watercraft of FIG. 1 wherein the foils and the shock absorbers are in three different operative orientations.
Figure 2B:
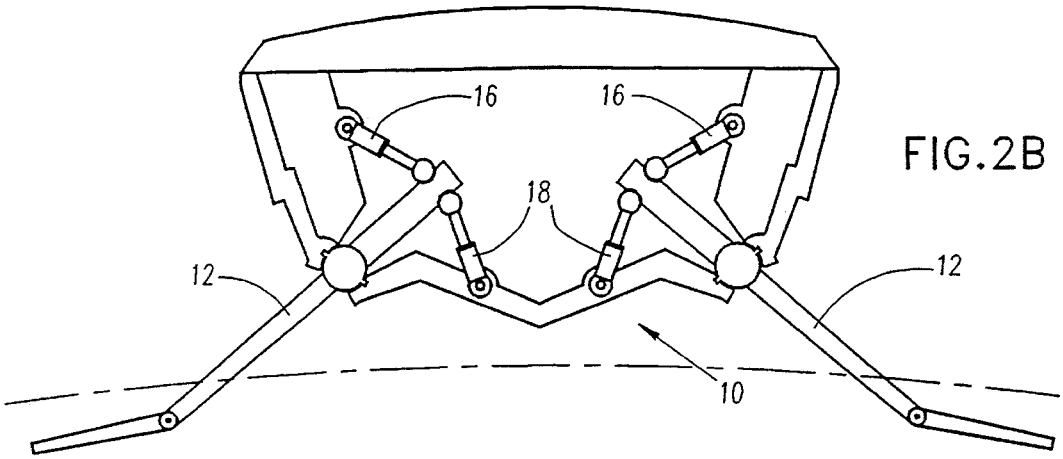
Figure 2C:
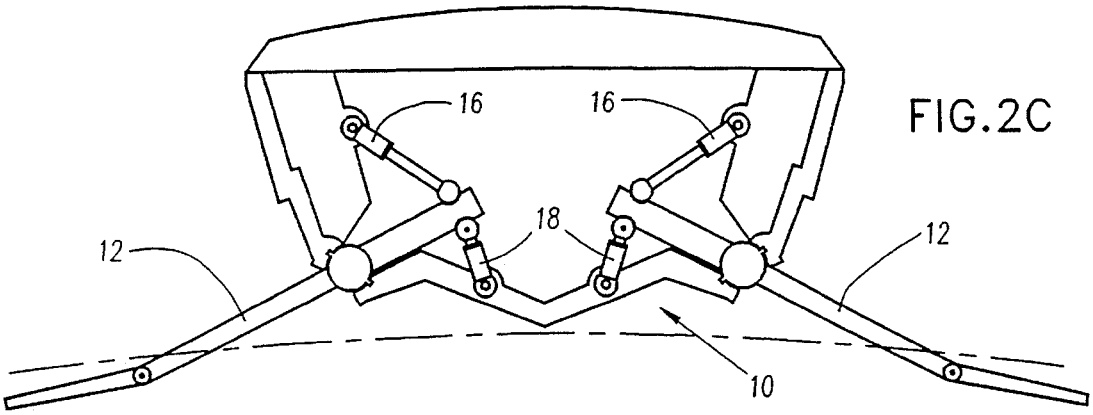
Figure 3A:
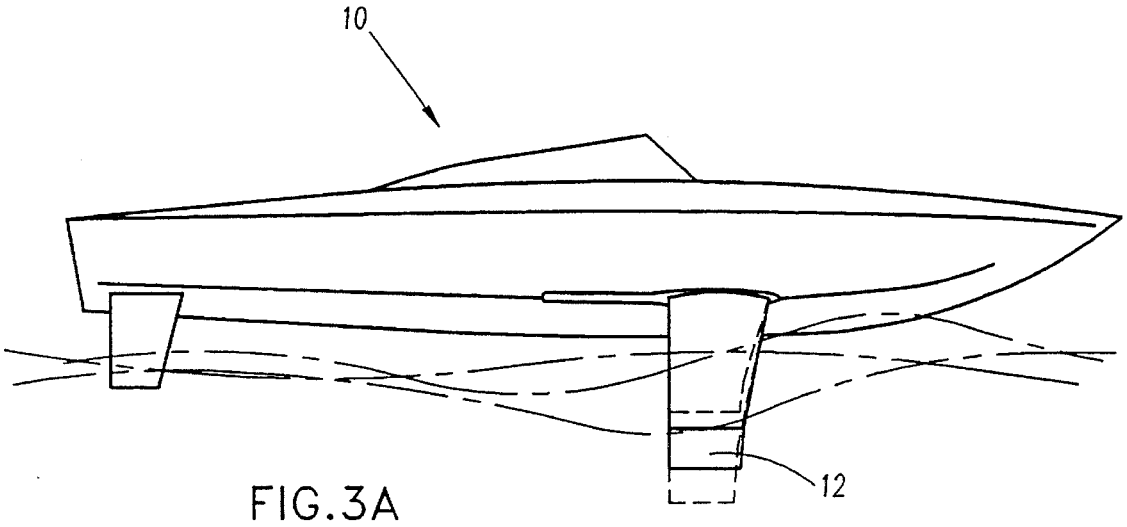
FIGS. 3A and 3B are respective side view and bottom view illustrations of the watercraft of FIG. 1, each of which illustrates the orientations of the foils in the three different operative orientations shown respectively in FIGS. 2A, 2B and 2C.
Figure 3B:
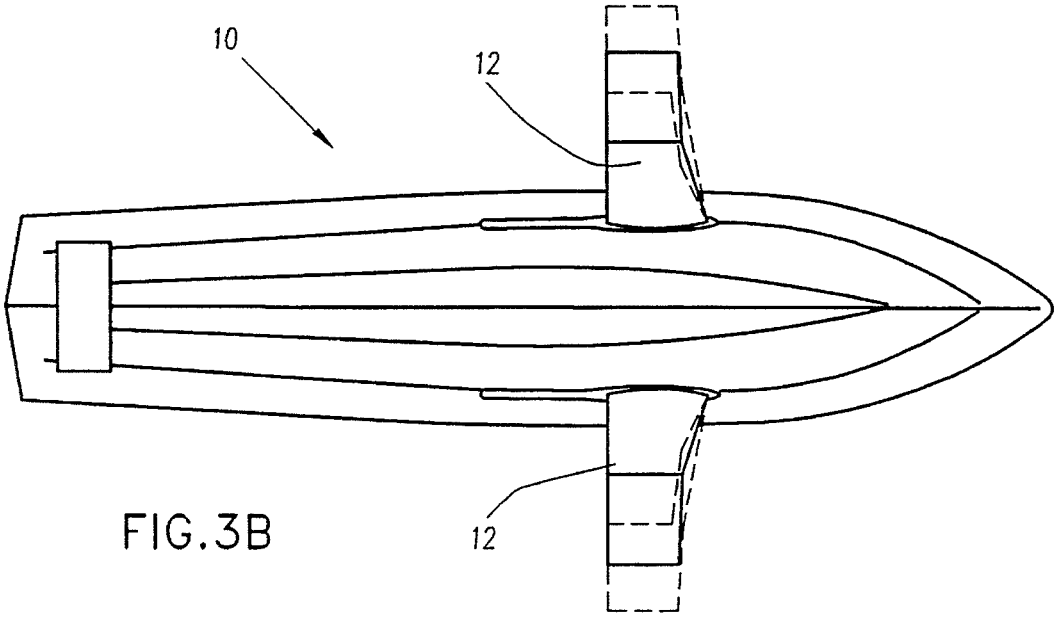
Figure 4:
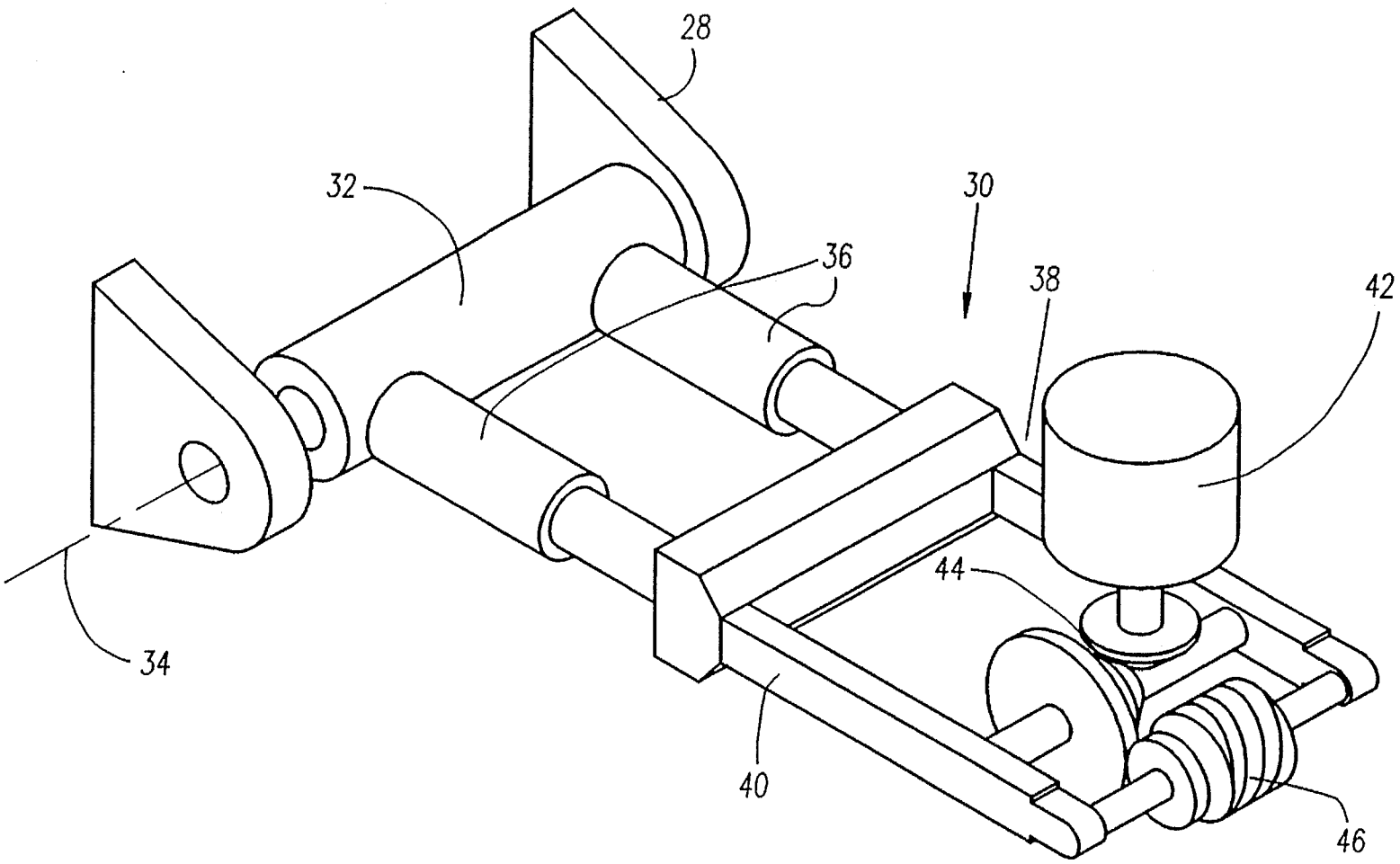
FIG. 4 illustrates part of shock absorber equipped apparatus for retracting foils which is useful in the embodiment of FIGS. 1–3B.

Reference is now made to FIGS. 1, 2A, 2B, 2C, 3A and 3B, which illustrate watercraft constructed and operative in accordance with a preferred embodiment of the present invention. The watercraft comprises a hull 10 and at least one pair of hydrofoils 12 associated with the hull for engagement with water. In accordance with a preferred embodiment of the present invention, shock absorbing apparatus is provided for absorbing mechanical shocks received from the waves and preventing them from being fully transferred to at least a portion of the hull.

In accordance with a preferred embodiment of the present invention, the shock absorbing apparatus comprises at least one shock absorber 16 associated with each foil 12 to absorb upwardly directed forces imparted thereto as a result of upward wave motion, and at least one shock absorber 18 associated with each foil to absorb downwardly directed forces imparted thereto as a result of the post-wave descending motion of the craft.

It is noted that the shock absorbers 16 and 18 are preferably pivotably mounted with respect to the foils 12 and are mounted onto the hull by means of brackets 20 engaging a pivotably mountable base 22. The shock absorbers may be of any suitable construction and may be commercially available mechanical, hydraulic or pneumatic shock absorbers, such as Catalog No. R1061 of Monroe, Inc. of the U.S.A.

The extension and retraction of the shock absorbers 16 and 18 with different relative orientations of the foils 12 can readily be seen from a consideration of FIGS. 2A–2C and 3A–3B which illustrate two extreme orientations and an intermediate orientation of the foils 12 relative to the hull 10.

In accordance with the teachings of applicant's U.S. Pat. No. 4,715,304, the foils may be retractable.

Figure 5A:
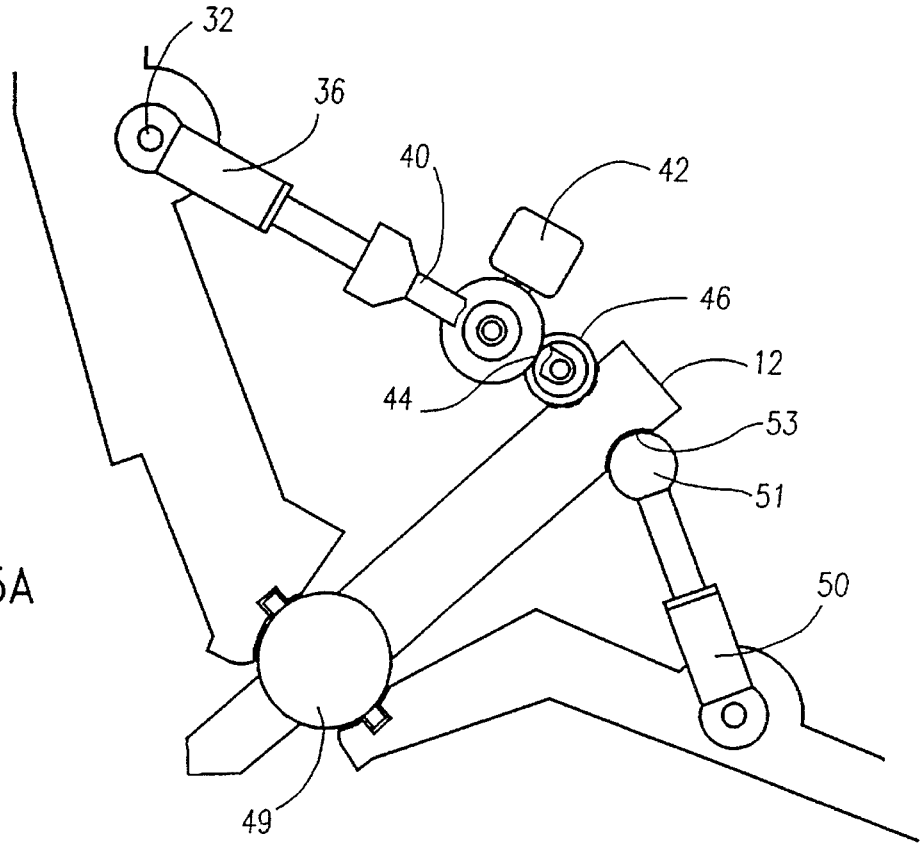
FIGS. 5A and 5B are illustrations of the apparatus of FIG. 4 in engagement with foils in two alternative foil orientations.
Figure 5B:
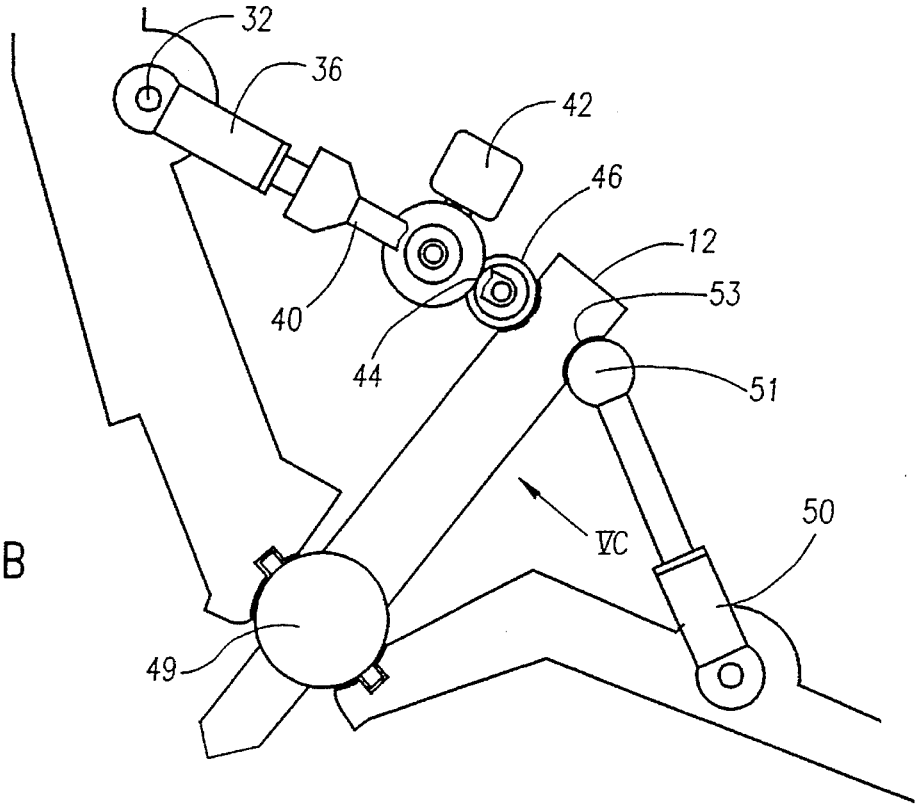
Figure 5C:
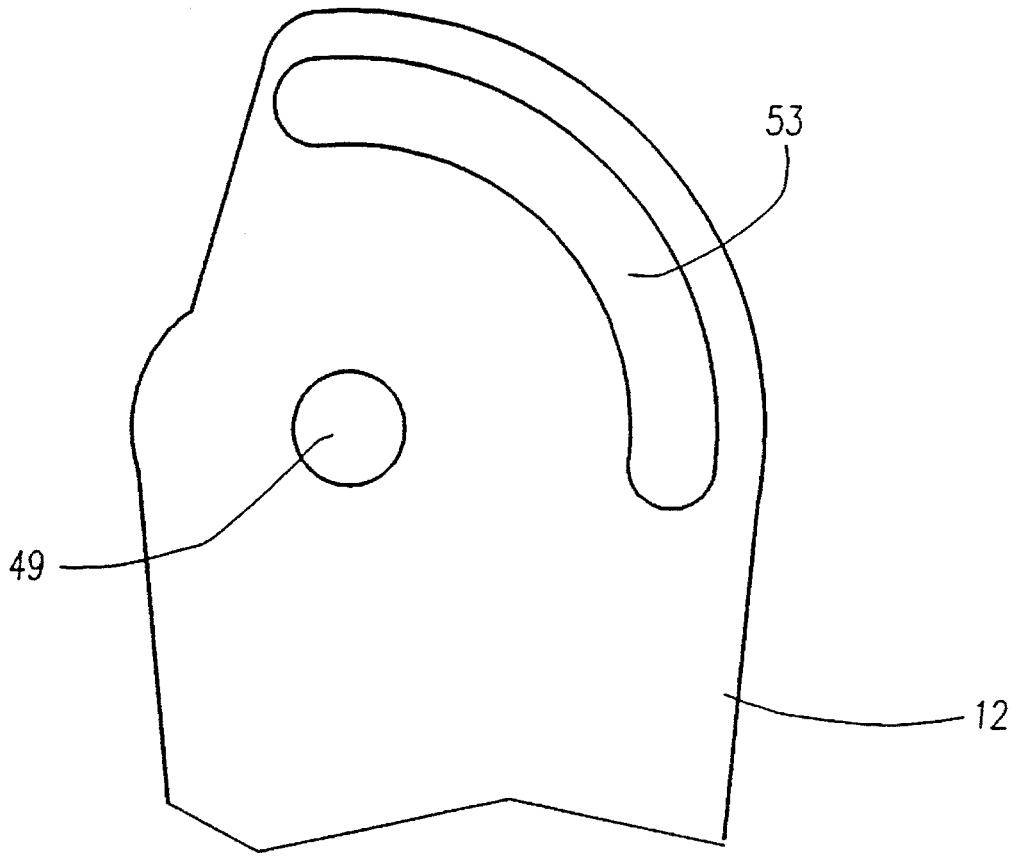
FIG. 5C is an illustration of part of the underside of a foil in the configuration of FIGS. 5A and 5B.
Figure 6A:
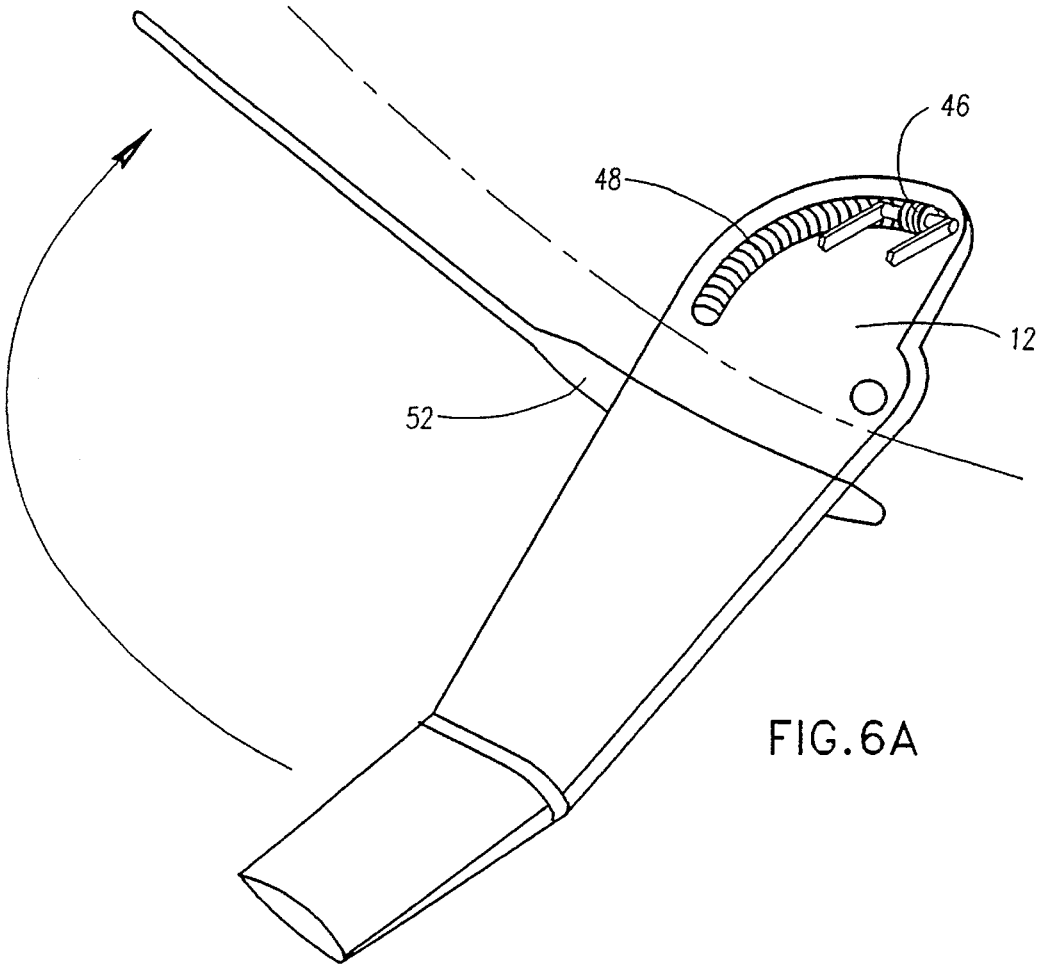
FIGS. 6A and 6B are illustrations of part of the apparatus of FIG. 4 in engagement with foils in respective extended and retracted orientations.
Figure 6B:
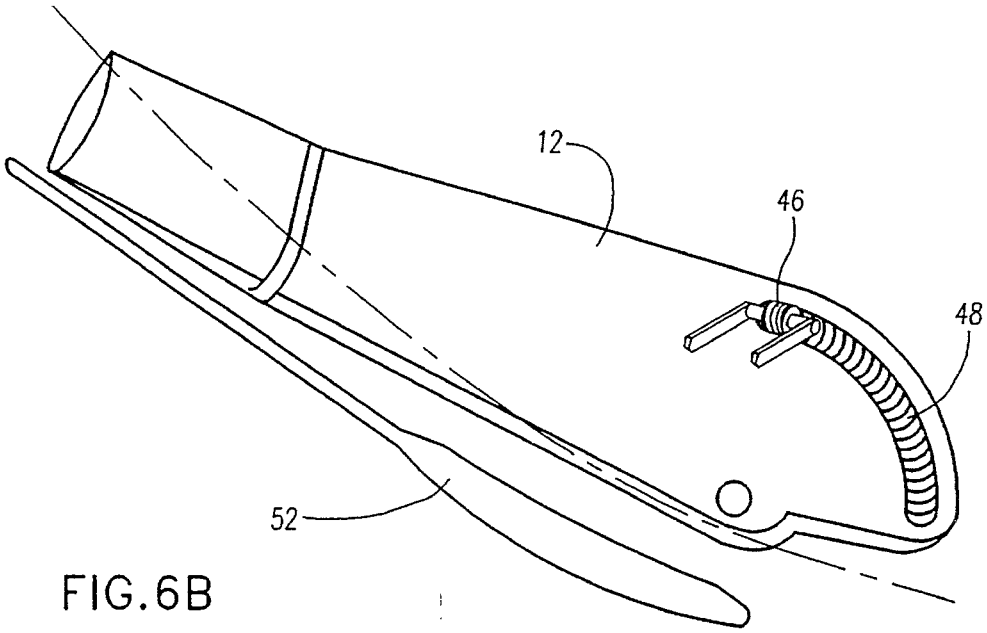

Reference is now made to FIGS. 4–6B, which illustrate an embodiment of the invention employing retractable foils. In this embodiment, there is provided foil retraction and shock absorbing apparatus 30, typically comprising a pivotably mountable base 32 arranged along a pivot mounting axis 34, mounted by means of brackets 28 onto the hull, and onto which are mounted a pair of shock absorbers 36, of any suitable type. Shock absorbers 36 preferably extend generally perpendicular to axis 34 and support a foil retraction subassembly 38. Subassembly 38 includes a frame 40 onto which are mounted a motor 42 of any suitable type, which drives, via suitable gearing 44, a worm gear 46. Worm gear 46 operatively engages gearing grooves 48 formed in or otherwise associated with a retractable hydrofoil 12, as illustrated in FIGS. 6A and 6B. Rotation of the worm gear 46 in engagement with gearing grooves 48 provides extension or retraction of the hydrofoil 12 relative to the hull.

It is a particular feature of the embodiment of FIGS. 4–6B, that irrespective of the orientation of the hydrofoil 12, which may be at any suitable orientation at or between its extreme positions illustrated in FIGS. 6A and 6B, shock absorption is provided by the shock absorbers 36 (FIG. 4) operating in cooperation with additional shock absorbers 50 arranged at an opposite surface of the foil 12.

Foil 12 is supported in the hull in any orientation by means of a ball pivot and pin assembly 49 and an edge of an opening 52 and is positioned by shock absorbers 36 having associated therewith worm gear 46, which engages groove 48 on the upper surface of the foil, paired with shock absorber 50, having associated therewith a ball pivot end 51 which engages a correspondingly located groove 53 on the underneath surface of the foil (FIG. 5C).

Reference is now made to FIGS. 7–9B, which illustrate hydraulic apparatus for governing the orientation of the tip 60 of a hydrofoil 62 relative to the main portion 64 of the hydrofoil.

A foil mounting pin 201 has integrally formed therein a hydraulic valve 202. The pin 201 is pivotably seated in a socket 207 integrally formed in a wall 208 of the hull. Also integrally formed in wall 208 is a cavity 211 for seating a ball pivot protrusion 205, integrally formed in hydrofoil 62. Formed in wall of ball pivot protrusion 205 is elongated groove 206 (FIG. 10).

Figures 7, 8, 10:
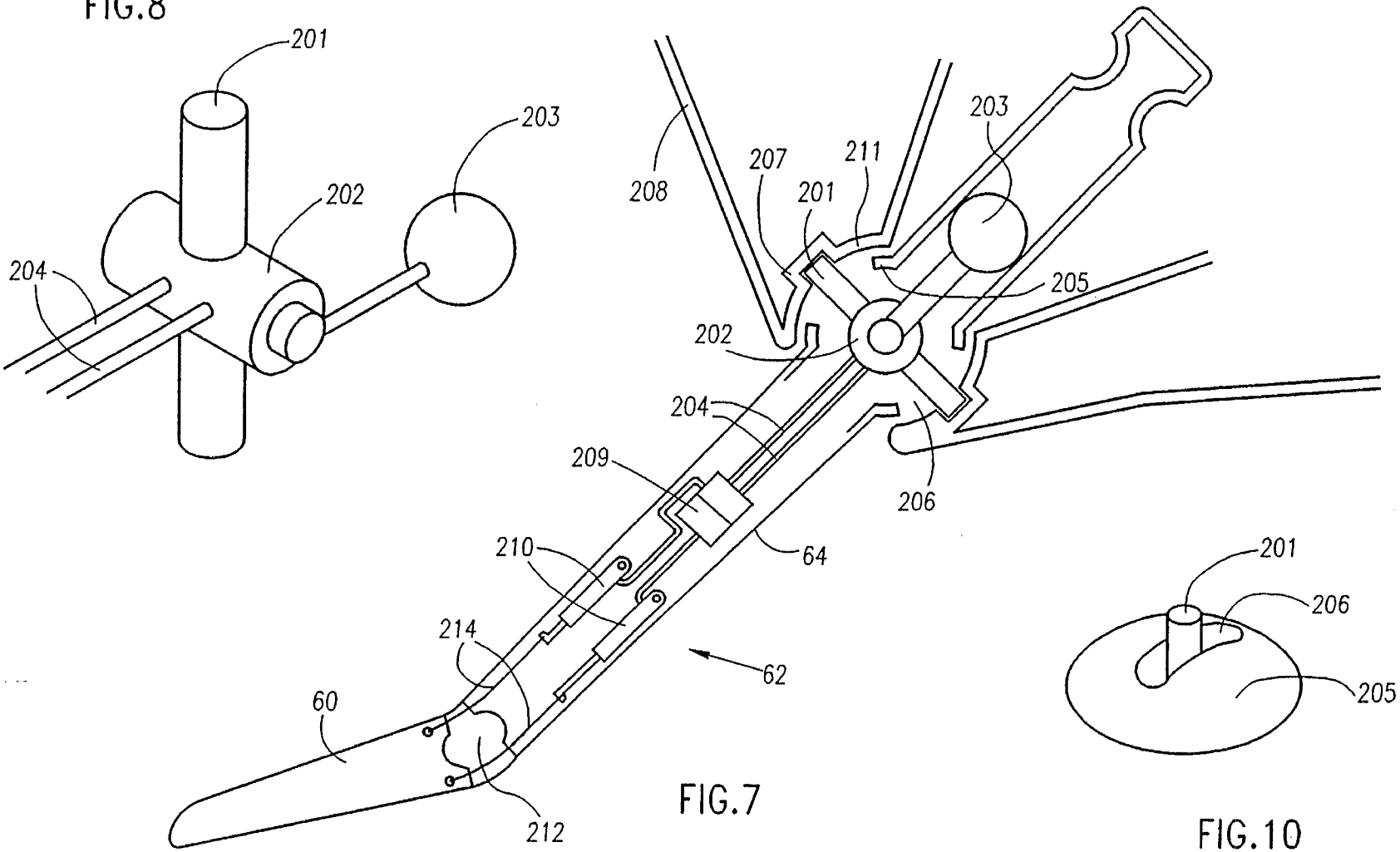
FIG. 7 is a simplified illustration of apparatus for mounting a foil and for governing the orientation of the tip thereof.
FIG. 8 is a simplified illustration of part of the apparatus of FIG. 7.
FIG. 10 is a simplified pictorial illustration of a portion of the apparatus of FIG. 7.
Figure 9A:
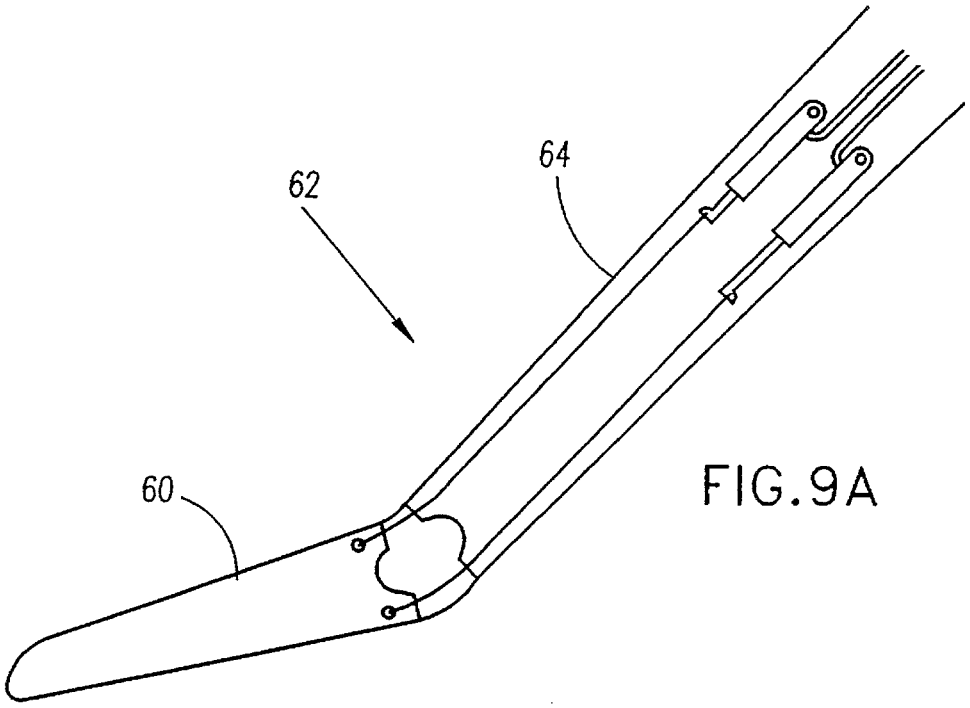
FIGS. 9A and 9B are illustrations of part of the foil of FIG. 7 in respective bent and straight orientations.
Figure 9B:
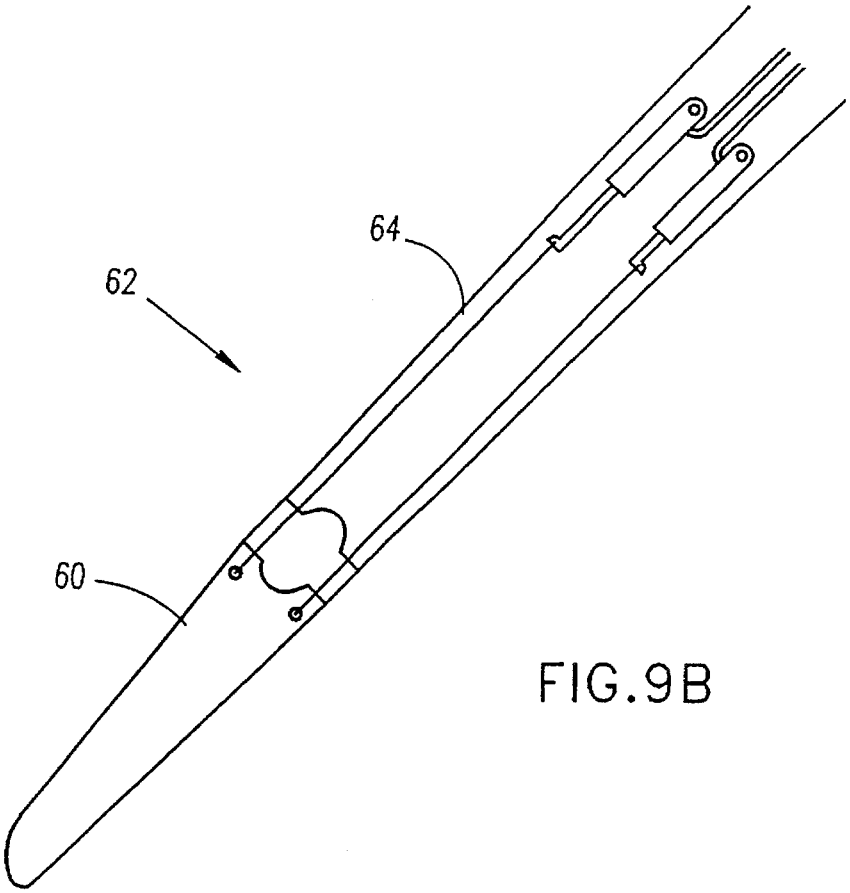

As the hydrofoil 62 changes its angle in the plane of FIG. 7 and the shock absorbers are operative, pivot protrusion 205 moves relative to pin 201 causing pin 201 to be in different relative positions along groove 206. This hydrofoil motion forces a valve control handle 203 to change its position relative to valve 202, thus effecting opening and closing of the valve. Valve 202 is connected via hydraulic conduits 204 to a power supply 209 which activates pistons 210. Pistons 210 activate cables 214 which effect a pivotal change in position of the tip 60 of hydrofoil 62 relative to main portion 64 thereof about a generally cylindrically shaped pivot 212, which may be made of any flexible substance such as flexible polyurethane.

Reference is now made to FIGS. 11A, 11B, 12A, 12B, 12C, 13A, 13B, 14 and 15 which illustrate watercraft constructed and operative in accordance with another preferred embodiment of the present invention. The watercraft comprises a hull 310 and at least one pair of hydrofoils 312 associated with the hull for engagement with water. In accordance with a preferred embodiment of the present invention, fluid filled resilient shock absorbing apparatus is provided for absorbing mechanical shocks received from the waves and preventing them from being fully transferred to at least a portion of the hull.

In accordance with a preferred embodiment of the present invention, the shock absorbing apparatus comprises a pair of fluid filled pillow assemblies 316 associated with each foil 312 to absorb upwardly directed forces imparted thereto as a result of upward wave motion, and downwardly directed forces imparted thereto as a result of the post-wave descending motion of the craft.

It is noted that the fluid filled pillow assemblies 316 are relatively flexible and thus can accommodate some pivotal motion of the foils 312 about ball pivots 317 in response to actuation of a piston and cylinder combination 318 operatively connected thereto and to hull 310.

Pillow assemblies 316 each typically comprise a plurality of fluid filled pillows 319, typically formed of suitable conventional rubber or plastic materials and filled with gas or a liquid. Normally the interiors of the fluid filled pillows of each assembly 319 are not interconnected, but rather the corresponding individual pillows 319 of a pair of pillow assemblies 316 lying on opposite sides of a foil 312 are interconnected by suitable conduit 320 and valves 324, which govern the rate of fluid flow therebetween and thus the amount and rate of damping produced by the assemblies. Valves 324 may be manually or automatically controlled to vary the operating parameters of the shock absorbing apparatus for optimum performance under various conditions.

Figure 11B:
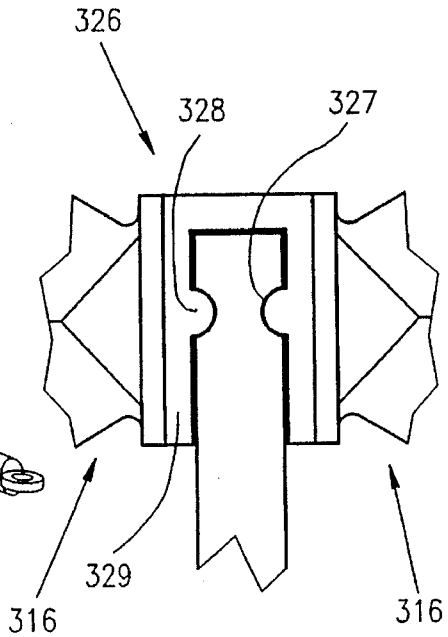
FIGS. 11A and 11B are respective general and detailed illustrations of the use of an alternative embodiment of shock absorbers in accordance with a preferred embodiment of the invention.
Figure 11A:
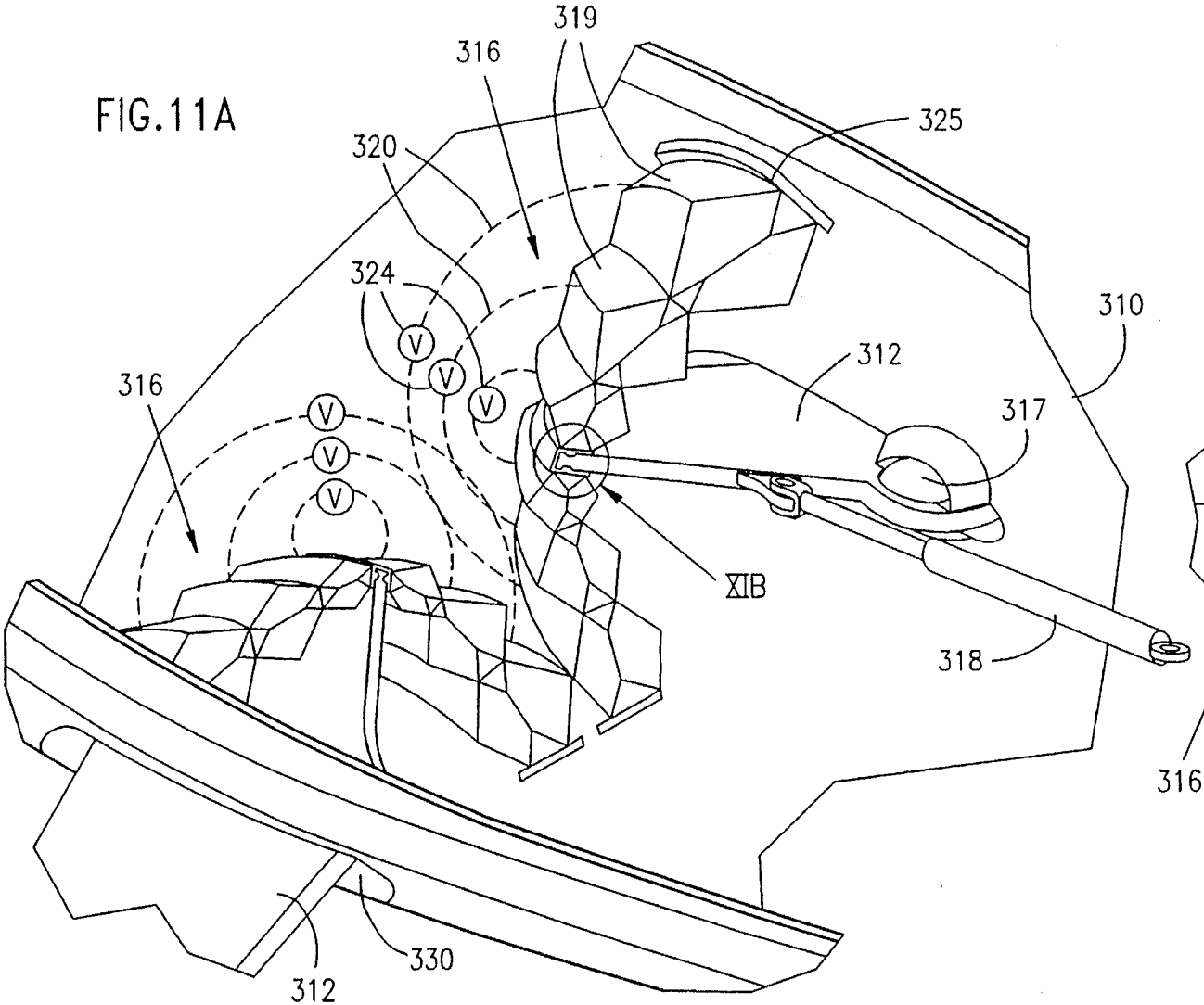
Figure 12A:
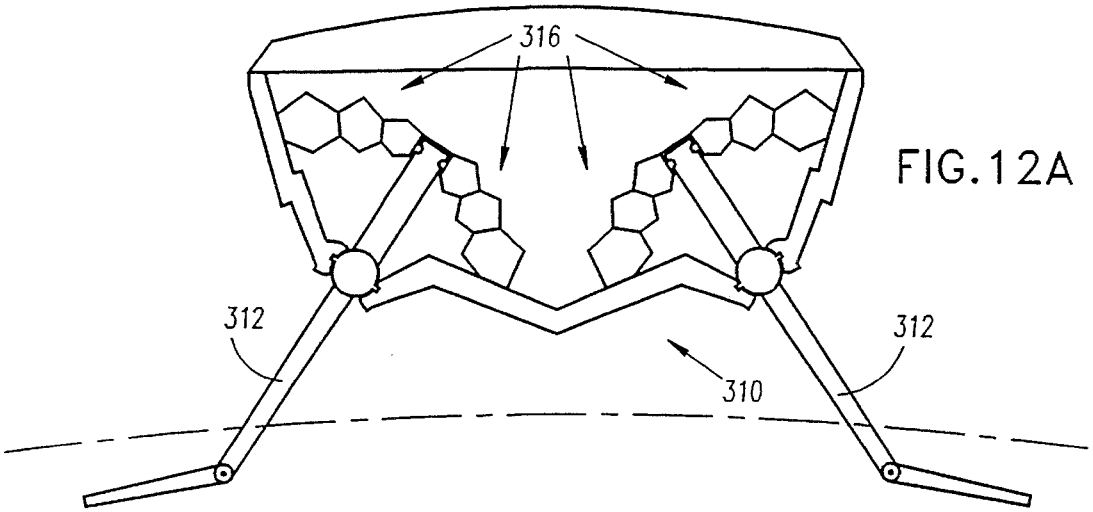
FIGS. 12A, 12B and 12C are illustrations of the operation of the apparatus of FIGS. 11A and 11B wherein the foils and the shock absorbers are in three different operative orientations.
Figure 12B:
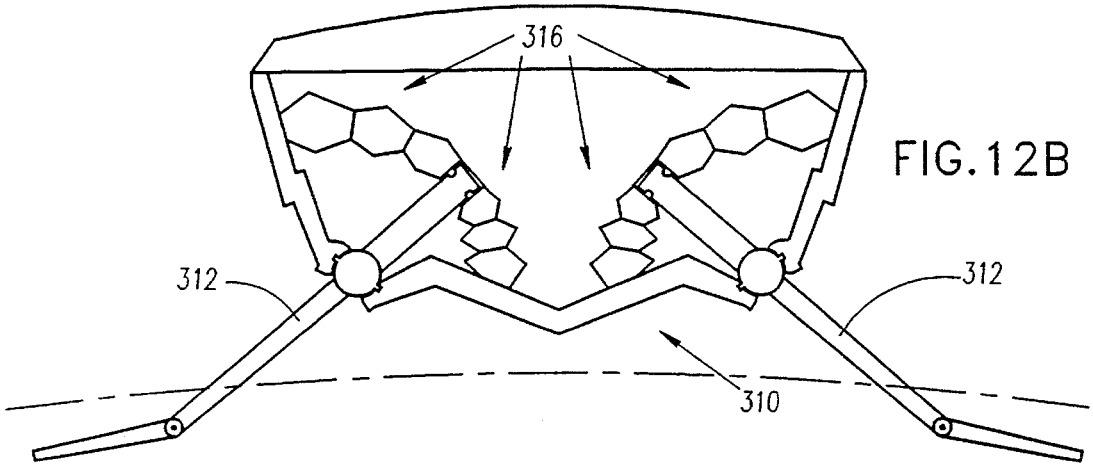
Figure 12C:
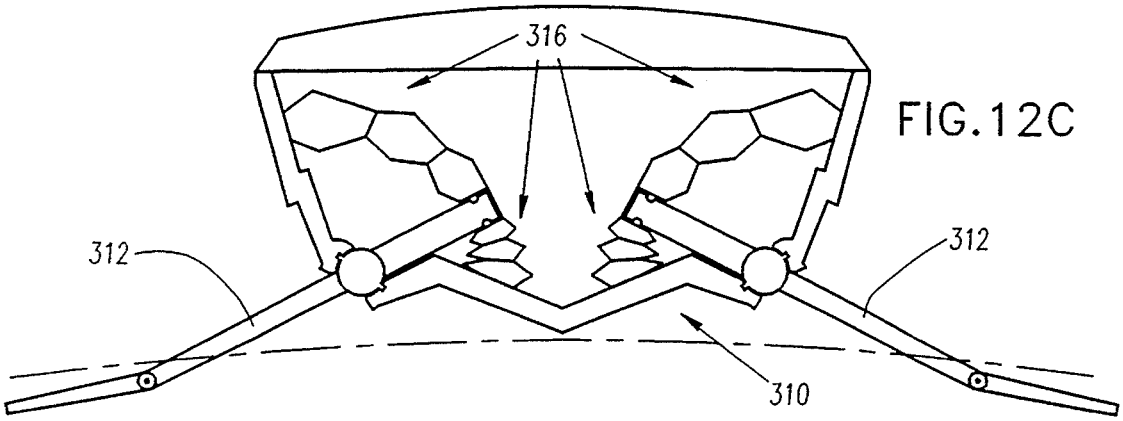
Figure 13A:
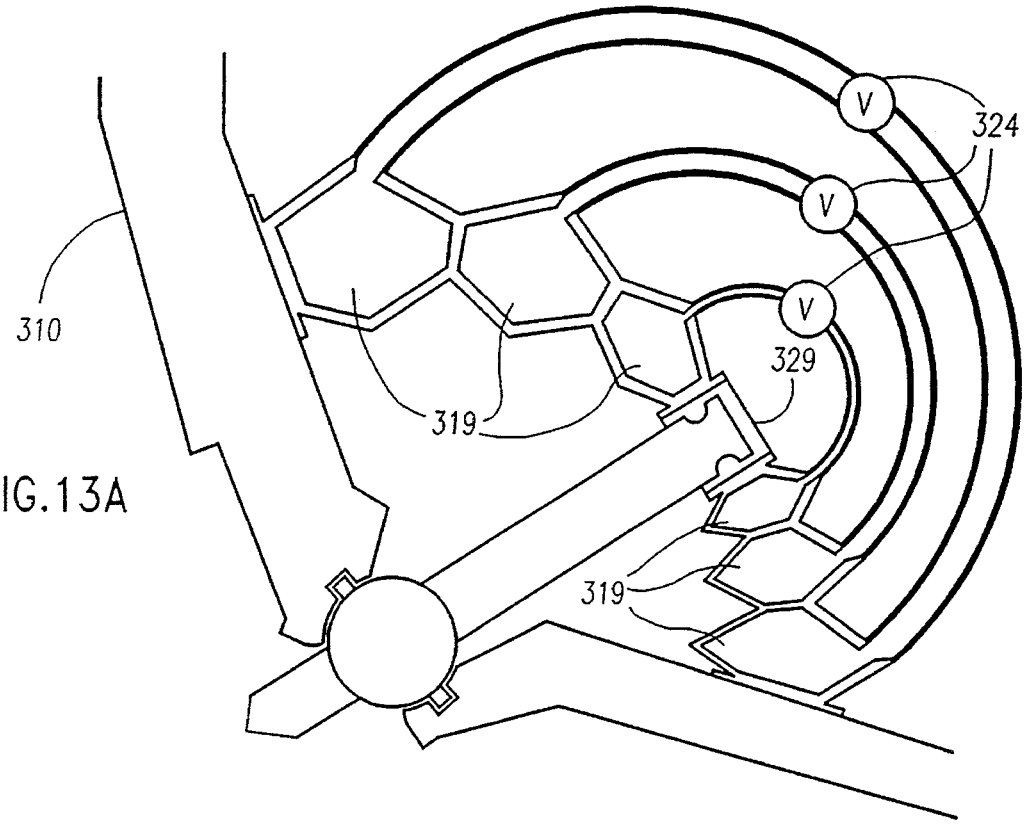
FIGS. 13A and 13B are respective side sectional view illustrations of the apparatus of FIGS. 11A and 11B, each of which illustrates the orientations of the foils in a different operative orientation.
Figure 13B:
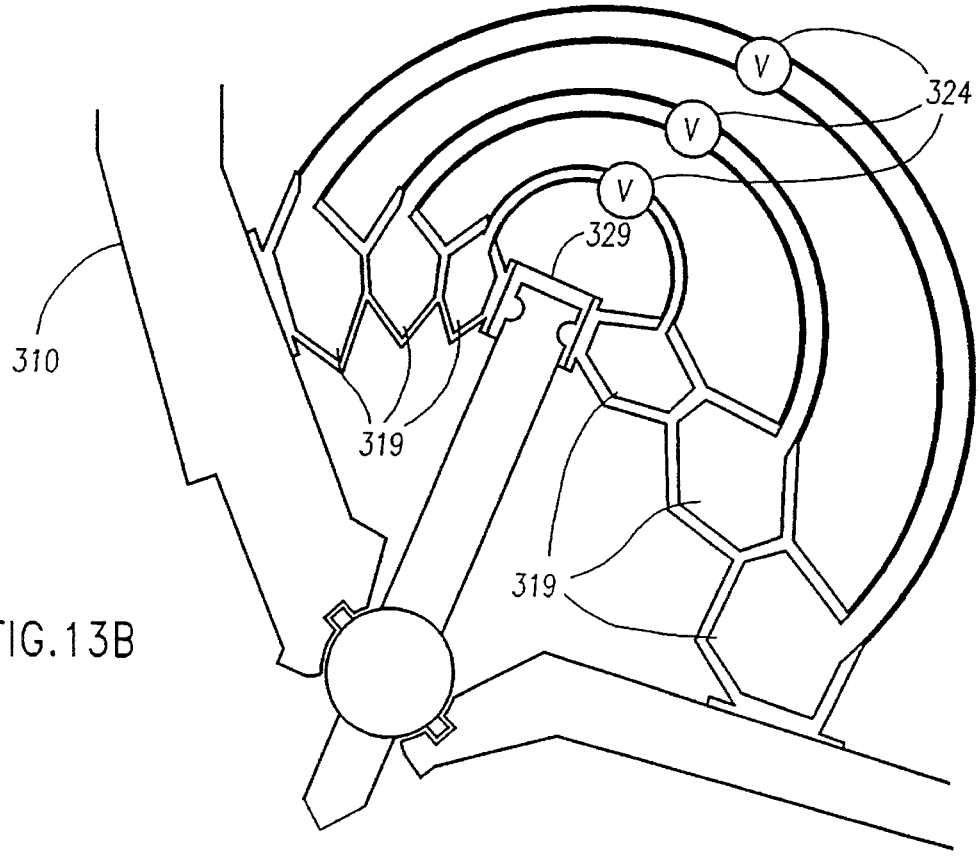
Figure 14:
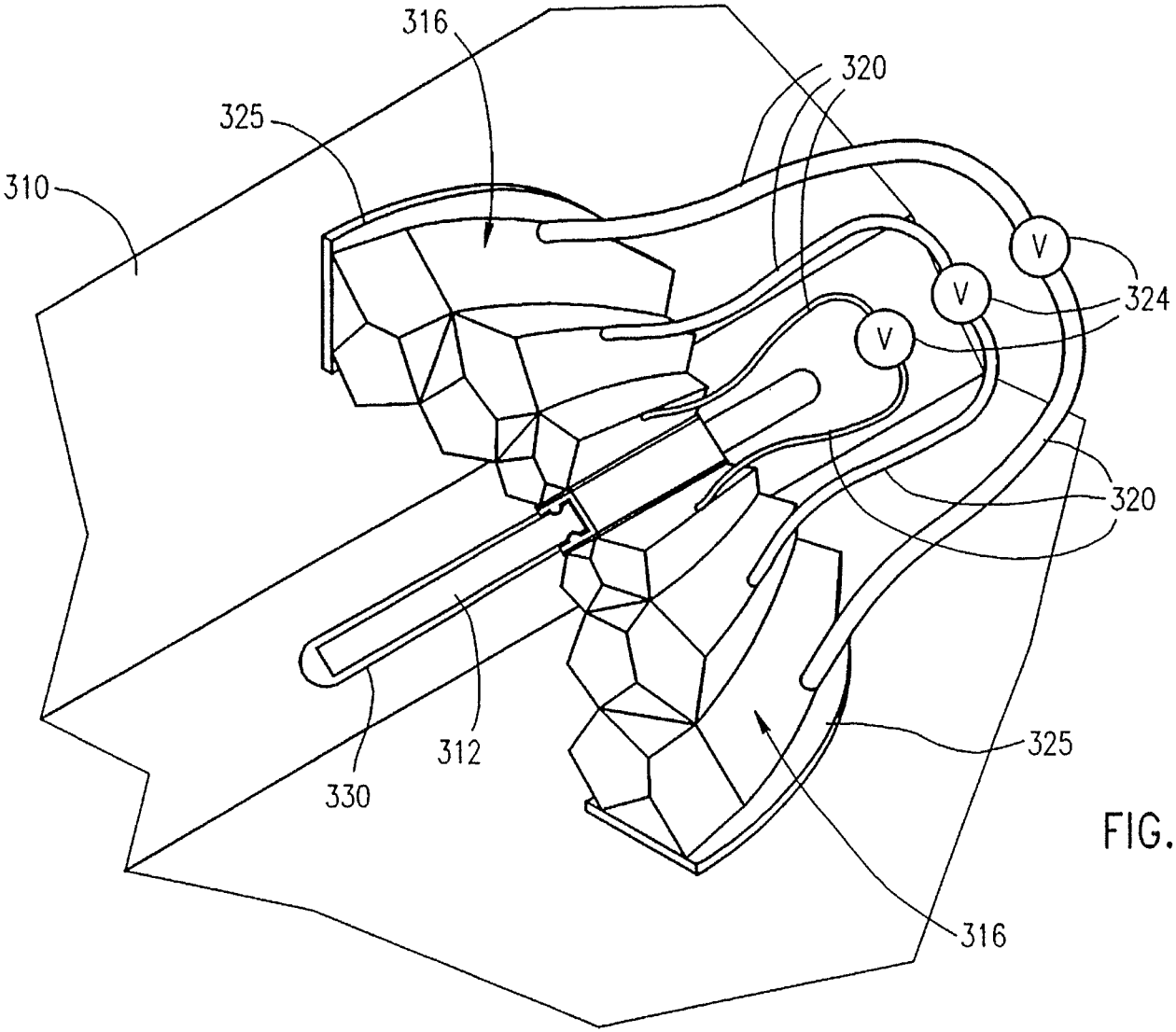
FIG. 14 illustrates part of shock absorber equipped apparatus for foils which is useful in the embodiment of FIGS. 11A–13B.

Pillow assemblies 316 are mounted onto the hull 310 by means of brackets 325 and onto the foils 312 by means of a mounting assembly 326, which is illustrated in FIG. 11B. It is seen from FIG. 11B that an elongate curved recess 327 extending along the peripheral edge of foil 312 is slidably engaged by low friction solidified filling material 328, which forms part of a bracket 329 to which both of the pair of pillow assemblies 316 are mounted.

The slidable engagement between material 328 and foil 312 is designed to accommodate pivotal motion of the foils 312 about ball pivots 317 in response to actuation of a piston and cylinder combination 318 operatively connected thereto.

The extension and retraction of the pillow assemblies 316 with different relative orientations of the foils 312 can readily be seen from a consideration of FIGS. 12A–12C, 13A and 13B which illustrate two extreme orientations and an intermediate orientation of the foils 312 relative to the hull 310.

In accordance with the teachings of applicant's U.S. Pat. No. 4,715,304, the foils may be retractable as by piston and cylinder assembly 318. They are preferably fully retractable into the hull 310 via a slot 330.

Figure 15:
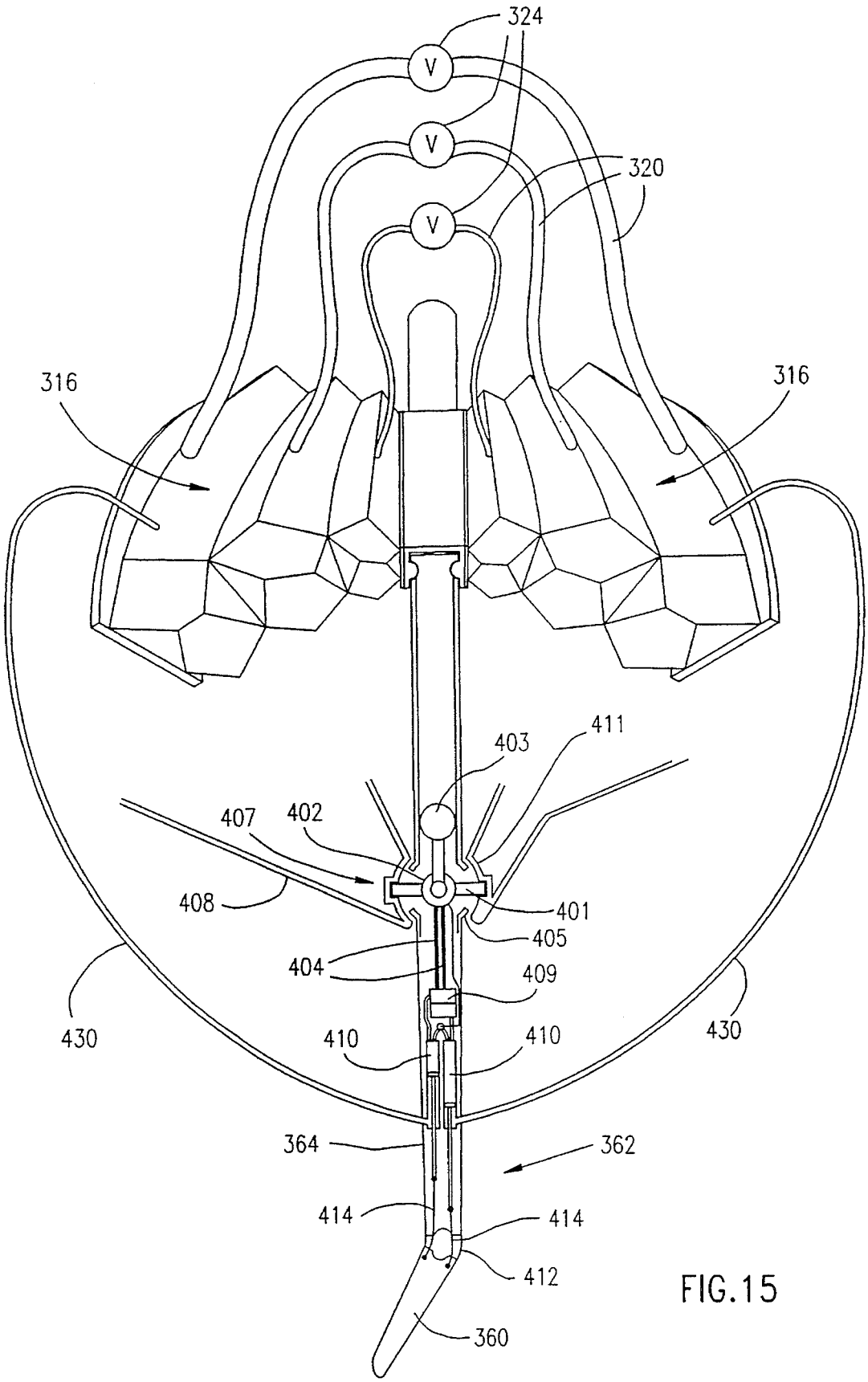
FIG. 15 is a simplified illustration of apparatus for mounting a foil and for governing the orientation of the tip thereof in accordance with another preferred embodiment of the present invention.

Reference is now made to FIGS. 15, which illustrates an alternative embodiment of hydraulic apparatus for governing the orientation of the tip 360 of a hydrofoil 362 relative to the main portion 364 of the hydrofoil.

A foil mounting pin 401 has integrally formed therein a hydraulic valve 402. The pin 401 is pivotably seated in a socket 407 integrally formed in a wall 408 of the hull. Also integrally formed in wall 408 is a cavity 411 for seating a ball pivot protrusion 405, integrally formed in hydrofoil 362, similarly to the embodiment of FIGS. 7 and 10. As the hydrofoil 362 changes its angle in the plane of FIG. 15 and the shock absorbing apparatus is operative, hydro-foil motion forces a valve control handle 403 to change its position relative to valve 402, thus affecting opening and closing of the valve. Valve 402 is connected via hydraulic conduits 404 to a power supply 409 which activates pistons 410.

Pistons 410 activate cables 414 which effect a pivotal change in position of the tip 360 of hydrofoil 362 relative to main portion 364 thereof about a generally cylindrically shaped pivot 412, which may be made of any flexible substance such as flexible polyurethane. Alternatively the mounting of tip 360 relative to main portion 364 may be by means of an ordinary hinge or a ball mounting.

In accordance with a preferred embodiment of the invention, pistons 410 each receive a fluidic input from a respective one of the pillow assemblies 316 via a respective conduit 430.

The apparatus of FIG. 15 enables the angular orientation of the tip 360 relative to the water surface to be maintained notwithstanding changes of the orientation of the main portion 364.

It will be appreciated by persons skilled in the art that the present invention is not limited by what has been particularly shown and described hereinabove. Rather the scope of the present invention is defined only by the claims which follow:

I claim:

1. Watercraft comprising:

a hull;

a plurality of foils mounted in the hull for engaging water; and shock absorbing means associated with the plurality of foils for coupling the plurality of foils to at least a portion of the hull and providing at least partial absorption of shock from waves in the water, wherein said plurality of foils each includes a main portion and a tip portion and means for controlling orientation of the tip portion relative to the main portion.

2. Apparatus according to claim 19 and wherein said shock absorbing means includes pivotably mounted shock absorbers engaging said plurality of foils on opposite surfaces thereof.

3. Apparatus according to claim 1 and wherein said foils include shock absorber engagement grooves formed in opposite surfaces thereof and said shock absorbing means includes means for engaging said grooves at different locations therealong depending on the positions of the foils.

4. Apparatus according to claim 1 and wherein each of said plurality of foils includes a main portion and a tip portion which is selectably positionable relative to said main portion.

5. Apparatus according to claim 4 and also comprising automatically operable hydraulic means for positioning the tip portion relative to the main portion as a function of angular orientation of the foil.

6. Apparatus according to claim 4, wherein said shock absorbing means comprise fluid filled pillows and also comprising means for permitting fluid flow from said fluid filled pillows to said hydraulic means.

7. Apparatus according to claim 1 and wherein said shock absorbing means comprises fluid filled pillows.

8. Apparatus according to claim 7 and wherein said fluid filled pillows are located on at least one side of the foil.

9. Apparatus according to claim 8 and wherein said fluid filled pillows are operative to exert a compressive force on one side of the foil and simultaneously to exert a tension force on the opposite side of the foil for a range of foil positions.

10. Apparatus according to claim 8 and wherein said fluid filled pillows are arranged on opposite sides of each foil and are arranged to permit fluid flow between at least one pillow on one side of each foil to at least one pillow on the other side of the foil.

11. Apparatus according to claim 7 and wherein said fluid filled pillows are operative to exert a compressive force on one side of the foil and simultaneously to exert a tension force on the opposite side of the foil for a range of foil positions.

12. Apparatus according to claim 11 and wherein said fluid filled pillows are arranged on opposite sides of each foil and are arranged to permit fluid flow between at least one pillow on one side of each foil to at least one pillow on the other side of the foil.

13. Apparatus according to claim 7 and wherein said fluid filled pillows are arranged on opposite sides of each foil and are arranged to permit fluid flow between at least one pillow on one side of each foil to at least one pillow on the other side of the foil.

14. Apparatus according to claim 13 and also comprising a valve interposed between at least one pillow on one side of each foil and at least one pillow on the other side of the foil to control the fluid flow therebetween.

15. Watercraft comprising:

a hull;

a plurality of foils mounted in the hull for engaging water; and shock absorbing means associated with the plurality of foils for coupling the plurality of foils to at least a portion of the hull and providing at least partial absorption of shock from waves in the water, wherein said plurality of foils are retractable, and wherein said plurality of foils each includes a main portion and a tip portion and means for controlling orientation of the tip portion relative to the main portion.

16. Watercraft comprising:

a hull;

a plurality of foils mounted in the hull for engaging water;

shock absorbing mean associated with the plurality of foils for coupling the plurality of foils to at least a portion of the hull and providing at least partial absorption of shock from waves in the water; and shock absorber mounted means for selectably retracting said plurality of foils, wherein said shock absorber mounted means for selectably retracting said plurality of foils includes a motor driven worm gear assembly operatively engaging a threaded groove formed on a surface of each of said plurality of foils.

* * * * *